US010799741B2

(12) United States Patent
Jamesapollos

(10) Patent No.: US 10,799,741 B2
(45) Date of Patent: Oct. 13, 2020

(54) IMMERSIBLE, ADJUSTABLE, SURFACE COMPLIANT DEVICE AND METHODS OF USE

(71) Applicant: The Well Effect Company, Bedford, MA (US)

(72) Inventor: John Jamesapollos, Bedford, MA (US)

(73) Assignee: WE IP, LLC, Brooklyn, MA (US)

( * ) Notice: Subject to any disclaimer, the term of this patent is extended or adjusted under 35 U.S.C. 154(b) by 36 days.

(21) Appl. No.: 15/401,959

(22) Filed: Jan. 9, 2017

(65) Prior Publication Data

US 2018/0193684 A1 Jul. 12, 2018

(51) Int. Cl.
*A63B 5/11* (2006.01)
*A63B 21/16* (2006.01)
(Continued)

(52) U.S. Cl.
CPC ..... *A63B 5/11* (2013.01); *A63B 21/00069* (2013.01); *A63B 21/16* (2013.01);
(Continued)

(58) Field of Classification Search
CPC ..... A63B 5/11; A63B 21/00069; A63B 21/16; A63B 2225/605; A63B 2225/107;
(Continued)

(56) References Cited

U.S. PATENT DOCUMENTS 3,339,925 A * 9/1967 Nissen ..... A63B 5/11 473/469
4,149,712 A * 4/1979 Murphy ..... A63B 1/00 4/496

(Continued)

FOREIGN PATENT DOCUMENTS

CN 103418106 A 12/2013
DE 202009012880 12/2009

(Continued)

OTHER PUBLICATIONS https://www.youtube.com/watch?v=kvdtVsURQKM, published Mar. 29, 2010, last visited Aug. 27, 2018.*

(Continued)

*Primary Examiner* — Andrew S Lo
(74) *Attorney, Agent, or Firm* — McInnes & McLane, LLP; Jodi-Ann McLane

(57) ABSTRACT

The present invention relates to an immersible, adjustable, surface compliant device and methods of using it an environment with variable, induced current flows for purposes of exercise, rehabilitation, or pure fun. The adjustable, immersible, surface compliant device can be used in pools, water tanks, or any body of water having a location where the device could be attached. The adjustable, immersible, surface compliant device and methods of using it are ideal for rehabilitating an injury, assisting aging bodies in performing exercises, and allowing the permanently injured to achieve movement and some degrees of physical autonomy despite being injured. In some embodiments, I disclose a trampoline-like device, having adjustable surface compliance, to be used in a pool or water tank having a current flow, wherein the angle of the trampoline is horizontally adjustable.

18 Claims, 4 Drawing Sheets

(51) Int. Cl.
*A63B 21/00* (2006.01)
*A63B 69/12* (2006.01)
*A63B 22/00* (2006.01)
*A63B 21/02* (2006.01)

(52) U.S. Cl.
CPC ..... *A63B 21/023* (2013.01); *A63B 22/0023* (2013.01); *A63B 69/125* (2013.01); *A63B 2225/093* (2013.01); *A63B 2225/107* (2013.01); *A63B 2225/605* (2013.01)

(58) Field of Classification Search
CPC ..... A63B 2225/093; A63B 21/023; A63B 69/125; A63B 22/0023
See application file for complete search history.

(56) References Cited

U.S. PATENT DOCUMENTS 4,332,217 A * 6/1982 Davis ..... A01K 13/001 119/675
4,483,531 A * 11/1984 Laseman ..... A63B 5/11 482/27
4,576,375 A * 3/1986 Roberts ..... A63B 5/11 472/129
4,730,826 A * 3/1988 Sudmeier ..... A63B 5/11 482/28
4,776,581 A * 10/1988 Shepherdson ..... A63B 5/11 4/493
4,824,100 A * 4/1989 Hall ..... A63B 5/11 482/28
4,938,473 A * 7/1990 Lee ..... A63B 22/02 482/27
4,981,099 A * 1/1991 Holder ..... B63B 1/107 114/123
5,005,228 A * 4/1991 Mermelstein ..... A63B 69/125 4/488
5,123,641 A * 6/1992 Abboudi ..... A63B 21/0084 416/54
5,295,929 A * 3/1994 Weisz ..... A63B 22/02 4/495
5,378,213 A * 1/1995 Quint ..... A63B 22/02 198/849
5,487,713 A * 1/1996 Butler ..... A63B 71/0009 482/111
5,554,091 A * 9/1996 Patey ..... A63B 21/0552 4/577.1
5,558,604 A * 9/1996 Hopkins ..... A63B 22/02 482/111
5,752,899 A * 5/1998 Ballard ..... A63B 21/0084 482/111
5,921,892 A * 7/1999 Easton ..... A63B 22/02 482/54
5,947,870 A * 9/1999 Hall ..... A63B 5/11 482/27
6,162,061 A * 12/2000 Taylor ..... A63B 5/11 434/253
6,336,771 B1 * 1/2002 Hill ..... A63G 31/007 405/79
9,446,274 B1 * 9/2016 Chen ..... A63B 21/023
9,878,196 B2 * 1/2018 Lin ..... A63B 21/16
10,039,948 B2 * 8/2018 Chen ..... A63B 71/023
2005/0079955 A1 * 4/2005 Yang ..... A63B 5/11 482/27
2006/0105852 A1 * 5/2006 Curry ..... A63B 65/06 473/219
2007/0010374 A1 * 1/2007 Widich ..... A63B 5/11 482/27
2012/0264574 A1 * 10/2012 Chang ..... A63B 69/12 482/55
2013/0252787 A1 * 9/2013 Howell ..... A63B 5/11 482/29
2014/0005003 A1 * 1/2014 Howell ..... A63B 5/11 482/27
2014/0206505 A1 * 7/2014 DeBlanco, P.E. ..... A63B 5/11 482/27
2017/0157444 A1 * 6/2017 Conrad ..... A63B 5/11

FOREIGN PATENT DOCUMENTS

DE 102008033065 A1 * 1/2010 ..... A63B 5/11
EP 2208512 A1 7/2010
EP 2314357 A1 4/2011
FR 2657528 A1 8/1991
FR 3019753 A 10/2015
WO WO 2010006567 1/2010
WO WO 2010025782 3/2010

OTHER PUBLICATIONS https://www.youtube.com/watch?v=QUjnE0KrT1U, published Sep. 8, 2018, last visited Aug. 27, 2018.*
Eurotramp Trampoline—Underwater Trampoline (YouTube Video: https://youtu.be/uL-W-KtyaG8, published Sep. 23, 2013) (Year: 2013).*
Underwater Trampoline—Sensory Toys—Swimming; 2006.

* cited by examiner

IMMERSIBLE, ADJUSTABLE, SURFACE COMPLIANT DEVICE AND METHODS OF USE

FIELD

This invention is directed toward an immersible, adjustable, surface complaint device and methods of using the immersible, adjustable, surface compliant device.

BACKGROUND

For anyone who has ever been injured or who has sought a reduced gravitational environment for rehabilitation or performing exercise, the benefits of water-induced buoyancy and gentle resistance to movement or drag are enormous. Physical Therapists, when rehabilitating their patients who may have injuries, whether permanent or temporary, acute or minor, often take advantage of the properties of water to facilitate rehabilitation and provide more options to grade activities and reduce forces applied to the patient's body through motion when performing movements within water. Aquatic Therapy and Hydrotherapy encompasses a broad range of approaches and therapeutic methods that take advantage of the physical properties of water, such as temperature, buoyancy, velocity dependent resistance to movement, and hydrostatic pressure. These variables can be altered in ways that can stimulate blood circulation, assist in cardiovascular adaptation, increase muscle development, strengthen tendons and ligaments, improve range of motion, and treat symptoms of some diseases.

In some methods of hydrotherapy, practitioners have used trampolines either as medical devices capable of assisting users in rehabilitating injuries or as devices that provide exercise variety or simple, good old-fashioned fun. When a trampoline is submerged within a pool, there is a dual reduction in the amount of joint loading an individual bounding on the trampoline would experience if he or she were bounding on a solid surface outside of water. This dual reduction in joint loading is attributable firstly to the buoyancy of water, and secondly to the compliant surface of a trampoline. Individuals who are training, exercising, or rehabilitating generally seek to gradually increase the physical challenge they experience by resistance intensity and complexity of movements thereby increasing the difficulty of movements they perform and inducing a desirable adaptive response in the body. This has been done in prior art trampolines submersed underwater by changing the depth of the placement of the trampoline. While this provides some degree of flexibility in terms of designing a progressive training or rehabilitation regime, it would be advantageous to have more incremental variables of intensity and complexity of movement that could be altered along an individual's path to full recovery, partial recovery, pure enjoyment, or fitness training.

An example of a prior art immersible, surface complaint device used primarily for exercise purposes can be seen in U.S. Pat. No. 4,776,581 entitled "Exercise Apparatus," ("'581 patent") the entire contents of which are hereby incorporated by reference. The '581 patent describes a "receptacle or tank designed to be filled with water and housing a device such as a trampoline or other rebounder . . . for exercising the muscles and cardiovascular system of the user. The water provides increased resistance to movement, promoting the development of muscular tissue and promoting a rapid increase in heart rate. At the same time, this is done without stressing or otherwise traumatizing muscles and joints as running, jogging, conventional aerobics and the like do." Col. 1:15-24.

In terms of pure fun, French patent 2,657,528 A1, the entire contents of which are hereby incorporated by reference, is directed to a device used for aquatic sport exercise.

International patent publication WO 2010/006567, the entire contents of which are hereby incorporated by reference, combines clinical uses with pleasure.

In each of these prior art trampoline devices, irrespective of whether the trampoline is used as a purely recreational tool, or whether it is used as a healing modality, the trampoline is placed in a flat orientation on the bottom of a still pool or water tank. Each of these devices includes a traditional frame structure having a rigid portion mechanically coupled to the trampoline mat as well as legs upon which the trampoline is placed on the floor of a pool or water tank. This flat orientation on the bottom of a still pool or water tank limits both the intensity variations achievable and the complexity of movement that can be altered.

In additional uses of water trampolines, there are floating trampolines that usually contain a trampoline mat mechanically attached to some type of floating device, such as Styrofoam or an inner tube. In both of these instances, there is a displacement gap created by the framing structure of the trampoline when placed on the flat surface of the pool bottom or the flat surface of the water that allows the trampoline user to experience a vertical displacement when the user bounds on the trampoline. This vertical displacement against the springs of the rebounder surface is what creates the force that propels the user upward and, along with the depth of the water, are the only variables the user can alter. In water trampolines of the prior art, the force that propels the user upward has heretofore occurred only in a vertical orientation, as opposed to an angled orientation within a pool, water tank, natural body of water, or man-made body of water. The framing structures of prior art trampolines have been multi-planar in order to create the displacement gap.

It would be additionally advantageous to vary water temperature, water depth, water type, surface compliance, current flow and current direction. One example of a pool where there is a current flow is an Endless Pool®, where a motor creates flowing water that is used to allow a user to swim in place, much like a treadmill allows the walker to walk essentially in place.

There is, therefore, a need for an immersible, adjustable, surface compliant device and methods of using it a water environment with or without variable, induced current flows for purposes of exercise, rehabilitation, or pure fun.

SUMMARY OF THE INVENTION

The present invention relates to an immersible, adjustable, surface compliant device and methods of using it an environment with variable, induced current flows for purposes of exercise, rehabilitation, or pure fun.

In one embodiment, the present invention discloses an immersible, surface compliant device comprising an interior surface complaint portion mechanically coupled to a planar frame wherein the planar frame further comprises at least one adjustable tension device and means for securing the planar frame to a portion of an interior of a pool or a water tank.

In an alternate embodiment of the immersible, surface compliant device, the interior surface complaint portion is a trampoline mat.

In yet an alternate embodiment, of the immersible, surface complaint device, the interior surface compliant portion is a variable weave mesh, wherein various mesh weaves allow different permeability of water flow.

In a different embodiment, of the immersible, surface compliant device, the interior surface complaint portion is a rigid surface.

In yet an alternate embodiment, of the immersible, surface compliant device, the firmness of the interior surface complaint portion is adjustable.

An alternate embodiment disclosed herein comprises an immersible, surface compliant device comprising: a first interior surface complaint portion mechanically coupled to a planar frame wherein the planar frame further comprises at least one adjustable tension device; an interior pool frame having a plurality of attachment points and means for securing the interior pool frame to a portion of a pool or a water tank; and securing means for coupling the planar frame to the interior pool frame.

In a variation of this embodiment of the immersible, surface compliant device, the interior surface complaint portion is a trampoline mat.

In yet an additional variation of this embodiment of the immersible, surface compliant device the interior surface complaint portion is a rigid surface.

In a further variation of this embodiment of the immersible, surface compliant device, the firmness of the interior surface complaint portion is adjustable.

In a further variation of this embodiment of the immersible, surface compliant device, there is a second interior surface compliant portion mechanically coupled to a second planar frame, wherein the second planar frame further comprises at least one adjustable tension device.

In an alternate embodiment of the immersible, surface compliant device, the second interior surface compliant portion is a trampoline mat.

In yet an alternate embodiment, of the immersible, surface complaint device, the second interior surface compliant portion is a variable weave mesh, wherein various mesh weaves allow different permeability of water flow.

In an alternate embodiment the inventor discloses a method of performing an exercise while being at least partially submerged underwater comprising bounding on an immersible, surface compliant device, wherein the immersible, surface compliant device is titled at a vertical angle or a tilt angle ranging from five degrees to eighty-nine degrees.

In embodiments of this method, alternatively the method further comprising altering a water temperature, a water type, a water depth, a water pressure, a water temperature, a current flow velocity, a current flow direction, a surface compliance measurement of the interior surface compliant portion of the immersible surface compliant device, a vertical angle of the interior surface compliant portion of the immersible surface compliant device, or a tilt angle of the interior surface compliant portion of the immersible surface compliant device.

In an alternate embodiment there is a method further comprising bounding between the immersible surface compliant device and a second immersible surface compliant device, wherein the second immersible, surface compliant device is titled at a vertical angle or a tilt angle ranging from five degrees to eighty-nine degrees.

In yet an alternate embodiment, there is a method wherein the surface compliant device further comprises a trampoline mat.

In an additional embodiment, there is a method wherein the second surface compliant device further comprises a trampoline mat.

In yet an additional embodiment, there is a method further comprising altering a water temperature, a water type, a water depth, a water pressure, a water temperature, a current flow velocity, a current flow direction, a surface compliance measurement of the first or second interior surface compliant portion of the immersible surface compliant device, a vertical angle of the first or second interior surface compliant portion of the immersible surface compliant device, a tilt angle of the first or second interior surface compliant portion of the immersible surface compliant device, or a distance between the first or second interior surface compliant portion of the immersible surface compliant device.

List of Reference Numerals

Figure 1:
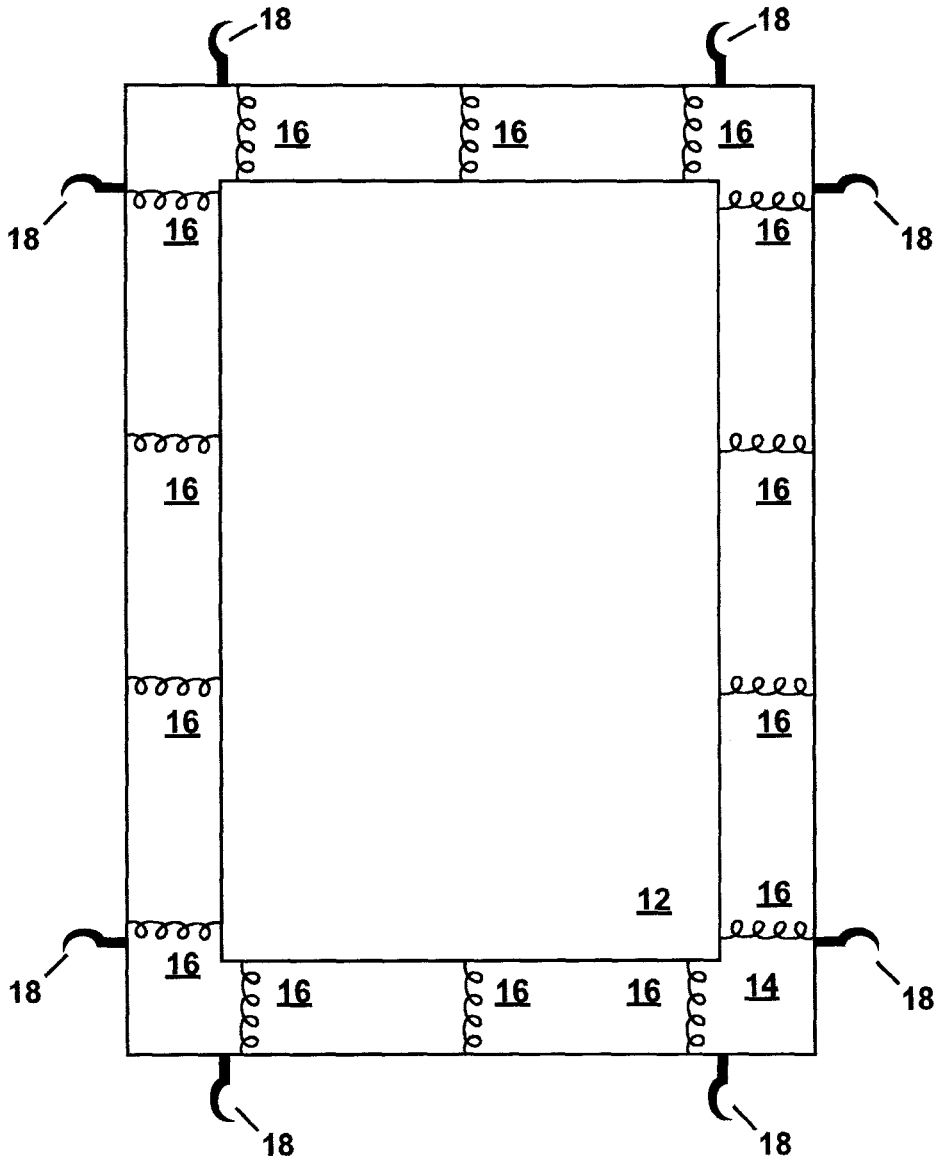
FIG. 1 is a front view of an immersible, adjustable, surface compliant device according to some embodiments disclosed herein.

| Reference Number | Description |
|---|---|
| 10 | immersible surface compliant device |
| 12 | interior surface compliant portion |
| 14 | planar frame |
| 16 | tension device |
| 18 | securing means |
| 30 | immersible surface compliant device |
| 31 | interior pool frame |
| 32 | interior surface compliant portion |
| 33 | attachment points |
| 34 | planar frame |
| 35 | frame securing means |
| 36 | tension device |
| 37 | angled conjoining surface |
| 38 | securing means |
| 40 | immersible surface compliant device |
| 41 | interior pool frame |
| 42 | first interior surface compliant portion |
| 43 | attachment points |
| 44 | planar frame |
| 45 | frame securing means |
| 46 | tension device |
| 47 | angled conjoining surface |
| 48 | securing means |
| 49 | second interior surface compliant portion |
| 61 | current flow |

DETAILED DESCRIPTION

Aquatic therapy is an excellent therapeutic, low-impact, variable resistance activity for people of all ages and abilities. Harnessing the physical properties of water to assist in patient healing and exercise performance through the use of aquatic therapy is an ideal solution for a variety of medical conditions. The buoyancy of water can reduce your body weight up to 90%, resulting in a low-impact, low-stress environment. The natural resistance of water, optionally enhanced with current in some embodiments disclosed herein, provides users with a challenging environment within in which to exercise, train, rehabilitate, or relax.

The embodiments disclosed herein provide benefits including without limitation:

(1) restoring the "joy of movement" using the aquatic environment, which is often lacking in injured, disabled, overweight, and elderly individuals; (2) increasing flexibility and strengthening muscles; (3) alleviating the symptoms of many medical conditions; (4) improving balance and agility; (5) decreasing joint swelling; (6) reducing pain; (7) enjoying simpler, less stressful exercise; (8) overcoming fear of the water; (9) developing confidence and a comfort level with being in water; (10) adding cognitive variety to training or physical therapy regimes; and (11) adding cross-training options to vary physical stresses on the body to avoid overuse injuries while improving fitness.

The embodiments disclosed in this application are directed toward an immersible, adjustable, surface compliant device and methods of using it an environment with variable induced current flows for purposes of exercise, rehabilitation, or pure fun. In terms of being immersible, the inventive devices and methods are designed to be used in a pool, a water tank, a natural body of water, or a man-made body of water (sometimes referred to in all variations of water types or in the short-hand version of simply "pools" and/or "water tanks" throughout).

Turning to the concept of adjustability, in devices and methods disclosed herein, the following variables can be adjusted: (1) water temperature; (2) water type; (3) water depth; (4) water pressure; (5) water temperature; (6) current velocity; (7) user orientation against current; (8) surface compliance of the immersible device; (9) vertical angle of compliant surface within water; and (10) tilt angle of compliant surface within water.

The present invention discloses both an apparatus and a method of using an immersible, adjustable, surface compliant device. Turning first to an apparatus embodiment of the present invention, FIG. 1 depicts an immersible, surface compliant device 10 having an interior surface compliant portion 12, which is mechanically coupled to a planar frame 14. The planar frame 14 provides structural integrity to the interior surface compliant portion 12, which is securely fastened to the planar frame 14. In alternate embodiments, the interior surface compliant portion 12 could be securely fastened to the planar frame 14 in a removable and interchangeable fashion so as to allow users to make adjustments to the surface compliance of the immersible, surface compliant device 10.

In addition, the planar frame 14 is further comprised of at least one tension device 16 wherein the tension device 16 can be used to vary the amount of spring in the immersible, surface compliant device 10. These tension devices 16 further facilitate the adjustability of the surface compliant device 10 and methods of use discussed herein. In alternate embodiments, the tension devices 16 could be springs, rubber bands, bungie cords, slats, wood, metal, fiberglass, plastic, rope, string, yarn, and the like.

In some embodiments, the interior surface compliant portion 12 could be a trampoline mat. In this embodiment, it is possible that a user would want to create a springy surface, as opposed to a firm surface, for the immersible, surface complaint device 10. Accordingly, this user may pair the trampoline mat with springs, rubber bands, or bungie cords as the tension devices 16.

In an alternate embodiment, the interior surface compliant portion 12 could be a variable mesh weave. In this embodiment, the mesh weave could vary with respect to the permeability of water flow through characteristics. A user could, for example, choose a mesh weave having less water flow through, and thereby creating a surface with more rigidity. Alternatively, the user could create a springier interior surface complaint portion 12 by choosing a mesh weave with a higher value of permeability.

In an alternate embodiment, where a user desires to create a more rigid immersible, surface compliant device 10, he or she could choose to have an interior surface compliant portion 12 made of fiberglass, plastic, wood, metal, glass, or similar rigid surface. For this embodiment, the user may choose a more rigid type of tension device 16 such as slats, wood, metal, fiberglass, plastic, rope, string, yarn, and the like.

In alternate embodiments, the firmness of the immersible, surface compliant device 10 could be adjustable. In these embodiments, the interior surface compliant portion 12 could be made of a padded foam surface mounted on a rigid substrate, while the tension devices 16 could be adjustable in terms of the spring constant in each. This could be accomplished using tension devices 16 that are themselves adjustable, including without limitation, springs, rubber bands bungie cords, and slats.

FIG. 1 also shows one type of securing means 18. In this embodiment, securing means 18 is a hook, which could be attached to an eyelet, pin, bar, rod or similar structure located within a pool or water tank. Securing means 18 could also be Velcro, spring hooks, swivel hooks, bolt snaps, dog leash snap hooks, trigger snaps, marine hooks, carabiners, lobster claws, tie downs, rope, bolts, screws, latches, eyelet hooks, straps, buckles, zippers, suction cups, magnets, and the like. Similarly, the portion within the pool or water tank could be fitted to receive any of these securing means 18 as is well understood within the art.

It is to be understood throughout this application that embodiments of the present invention are being discussed with reference to a pool or water tank. Those of skill in the art will recognize that the inventive device and methods of use thereof could just as easily be configured to work in a fresh water pond, spring, well, quarry, lake, or in a body of salt water as well. When the inventor describes a "pool" or "water tank" throughout this application, those of skill in the art will recognize that his teachings could be used in a body of water as described above by fitting an anchor point for the surface compliant device 10, 30, 40 into the body of water of interest. For example, the inventive devices and methods of use could be used in the ocean if they were attached to a portion of a raft, which could optionally be anchored within the ocean.

Figure 2:
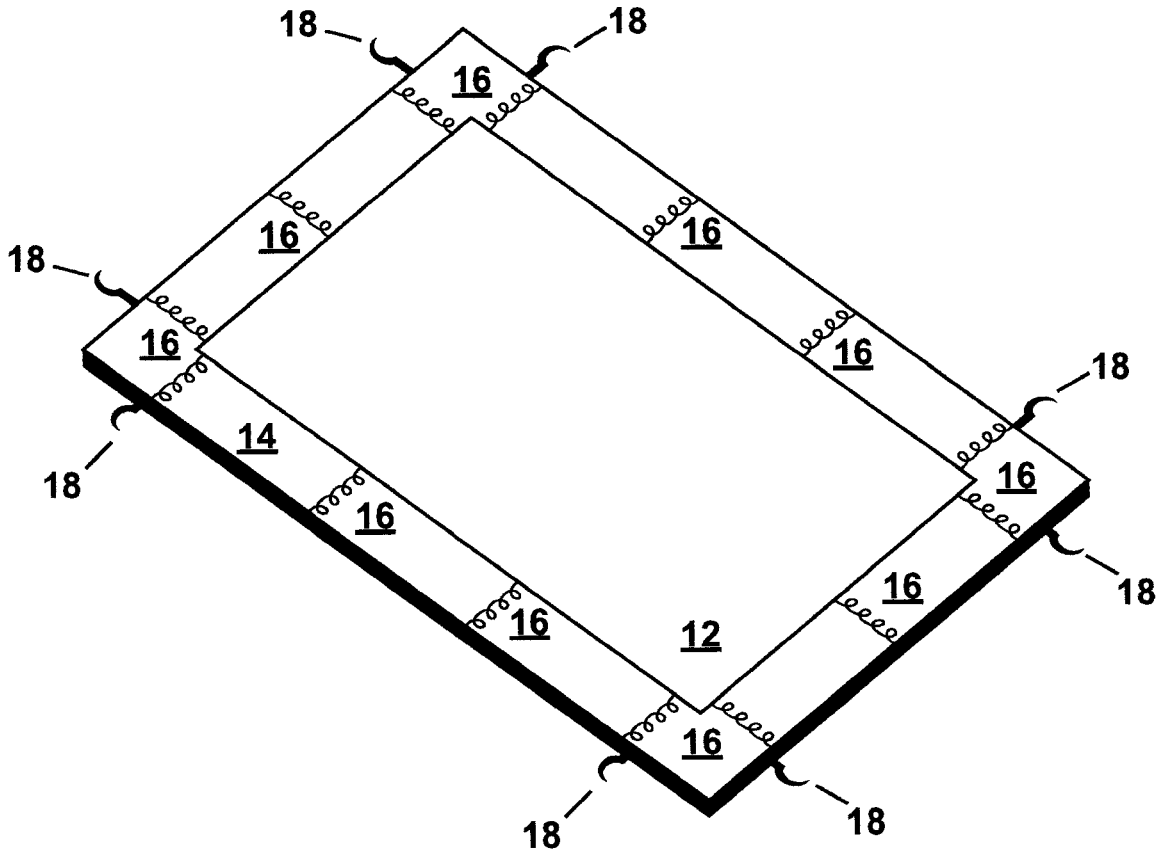
FIG. 2 is perspective view of an immersible, adjustable, surface compliant device according to some embodiments disclosed herein.

FIG. 2 shows a perspective view of these embodiments of the immersible, surface compliant device 10.

Figure 3:
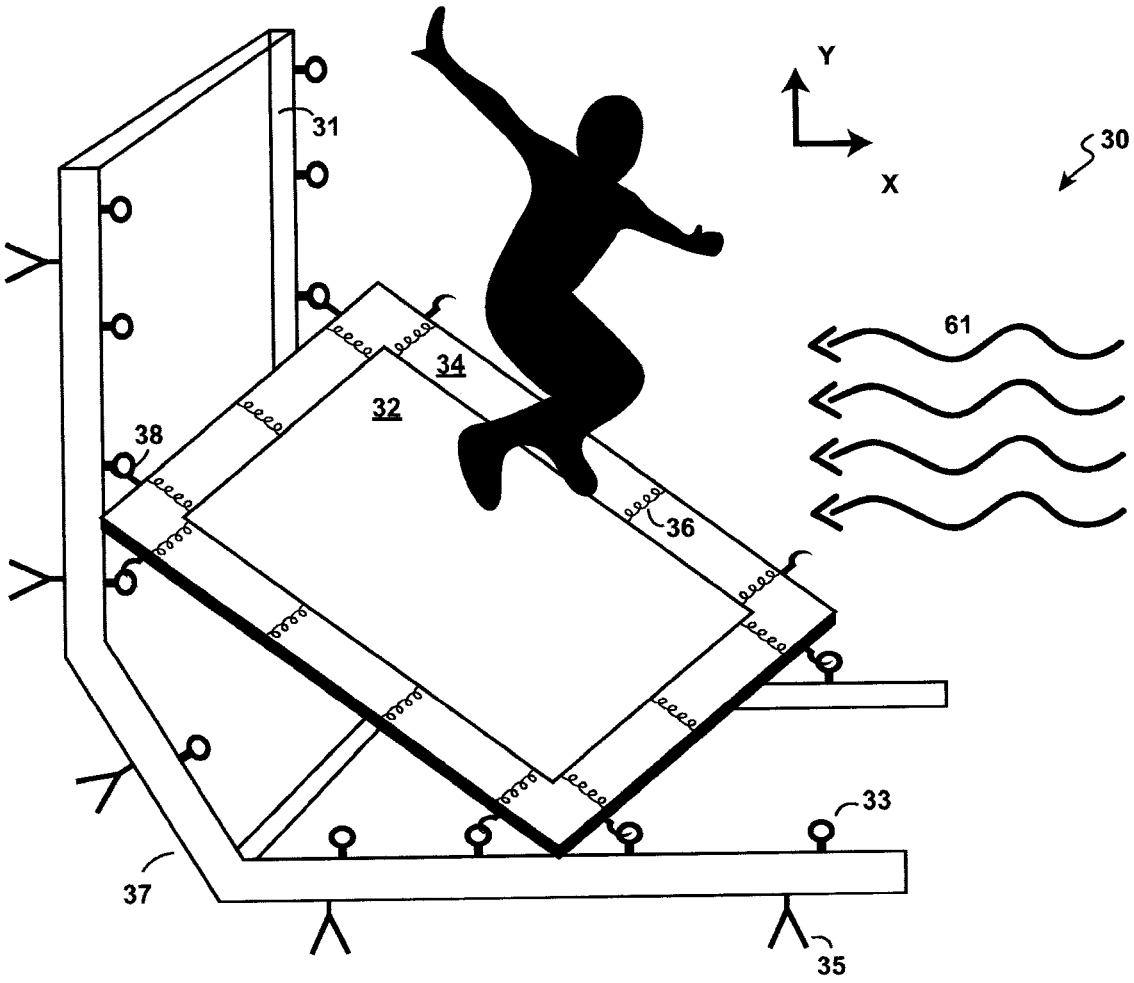
FIG. 3 is a perspective view of embodiments of an immersible, adjustable, surface compliant device having a frame for attaching to the interior of a pool.

FIG. 3 depicts an alternate embodiment of an immersible, surface compliant device 30. The embodiment of FIG. 3 is similar to that shown in FIGS. 1 and 2, the main difference being the addition of an interior pool frame 31 having a plurality of attachment points 33, and frame securing means 35 for securing the interior pool frame 31 to an interior of a pool, water tank, or other surface within a body of water.

The interior pool frame 31 is designed to be placed inside of a pool, water tank, or other body of water. In the embodiment pictured, the interior pool frame 31 is depicted as having an angled conjoining surface 37 as opposed to coming together in a perpendicular fashion. This is to accommodate the internal radius where the pool wall meets the pool bottom in most pools. In this embodiment, the interior pool frame 31 could be placed at the deep end, the shallow end, or along the side of the pool. In alternate embodiments, the angled conjoining surface 37 could be perpendicular or angled to fit into various interior proportions of pools, water tanks, and the like.

The interior pool frame 31 could be made of fiberglass, plastic, wood, metal, durable glass, ruggedized rubber, as well as any relatively rigid material. In addition, this embodiment of the immersible, surface compliant device 30 further comprises attachment points 33 for securing the planar frame 34 to the interior pool frame 31. FIG. 3 depicts these attachment points 33 as eyelets. Those of skill in the art will recognize that attachment points 33 could also be holes, rods, pins, Velcro, spring hooks, swivel hooks, bolt snaps, dog leash snap hooks, trigger snaps, marine hooks, carabiners, lobster claws, tie downs, rope, bolts, screws, latches, eyelet hooks, straps, buckles, zippers, suction cups, magnets, and the like.

In addition, FIG. 3 shows three different locations where the immersible, surface compliant device 30 could be secured. In FIG. 3, the immersible, surface compliant device 30 is placed at approximately a 45-degree angle. If the immersible, surface compliant device 30 was moved up in the y-axis direction, and toward the left in the x-axis-direction, the angle of incline for the immersible, surface compliant device 30 would be steeper. In contrast, if the immersible, surface compliant device 30 was moved lower on the y-axis and to the right along the x-axis, the angle of incline for the immersible, surface compliant device would be less.

Although FIG. 3 shows three (3) different angles of incline for the immersible, surface complaint device 30, it would be within the realm of those of skill in the art to include additional attachment points 33 thereby increasing the number of incline angles upon which the immersible, surface compliant device could be positioned to essentially add an infinitely adjustable range of angles in all of the planes of motion. In fact, in alternate embodiments, there could be a mechanical lift attached to the immersible, surface compliant device 30 on one end and anchored to the pool or pool frame 31 on the other end whereby the mechanical lift could be used to adjust the incline angle of the immersible, surface compliant device 30 over an infinite range of analog angles ranging from nearly horizontal to nearly vertical.

FIG. 3 also depicts frame securing means 35, which could comprise any of the following in any combination thereof: eyelets, holes, screws, bolts, pins, nails, rods, Velcro, spring hooks, swivel hooks, bolt snaps, dog leash snap hooks, trigger snaps, marine hooks, carabiners, lobster claws, tie downs, rope, bolts, screws, latches, eyelet hooks, straps, buckles, zippers, suction cups, magnets, a weighted anchor, and the like.

In alternate embodiments, interior frame 31 could be permanently attached to the interior of a pool, water tank, or body of water by using cement, glue, epoxy, welding, or other affixing means well known to builders and masons. Alternatively, the interior frame 31 could be affixed by creating interlocking ridges and grooves to mechanically secure the interior frame 31 to the interior surface of the pool, water tank, or body of water. The height and width of the interior frame 31 can be adjusted to accommodate the parameters of the body of water in which it is submersed.

The embodiment of FIG. 3 also includes an interior surface compliant portion 32 mechanically coupled to a planar frame 34. The planar frame 34 provides structural integrity to the interior surface compliant portion 32, which is securely fastened to the planar frame 34. In alternate embodiments, the interior surface compliant portion 32 could be removable and interchangeable.

In addition, the planar frame 34 is further comprised of at least one tension device 36 wherein the tension device 36 can be used to vary the amount of spring in the immersible, surface compliant device 30. In alternate embodiments, the tension devices 36 could be springs, rubber bands, bungie cords, slats, wood, metal, fiberglass, plastic, and the like. In some embodiments, the interior surface compliant portion could be a trampoline mat. In this embodiment, it is possible that a user would want to create a springy surface for the immersible, surface complaint device 30. Accordingly, this user may pair the trampoline mat with springs, rubber bands, or bungie cords as the tension devices 36.

In an alternate embodiment, where a user desires to create a more rigid immersible, surface compliant device 30, he or she could choose to have an interior surface compliant portion made of fiberglass, plastic, wood, metal, glass, or similar rigid surface. For this embodiment, the user may choose a more rigid type of tension device 36 such as slats, wood, metal, fiberglass, plastic, and the like.

In alternate embodiments, the firmness of the immersible, surface compliant device 30 could be adjustable. In these embodiments, the interior surface compliant portion 32 could be made of a padded foam mounted on a rigid substrate, while the tension devices 36 could be adjustable in terms of the spring constant in each. This could be accomplished using tension devices 36 that are themselves adjustable, including without limitation, springs, rubber bands bungie cords, and slats.

FIG. 3 also shows one type of securing means 38. In this embodiment, securing means 38 is a hook, which could be attached to an eyelet, pin, bar, rod or similar structure located within a pool or water tank. Securing means 38 could also be Velcro, spring hooks, swivel hooks, bolt snaps, dog leash snap hooks, trigger snaps, marine hooks, carabiners, lobster claws, tie downs, rope, bolts, screws, latches, eyelet hooks, straps, buckles, zippers, suction cups, magnets, and the like. Similarly, the portion within the pool or water tank could be fitted to receive any of these securing means 38 as is well understood within the art.

In terms of the displacement gap for the interior surface compliant portion 32, FIG. 3 shows that the displacement gap spans from the surface of the interior surface compliant portion 32 and the bottom of the pool or water tank. It is this distance, along with the spring characteristics of the immersible, surface compliant device, the properties of the water, including current flow 61, the weight of the user, and the amount of force he or she exerts when bounding that will affect the total distance traveled for each user bound. This is true for embodiments discussed with respect to FIGS. 1, 2, and 4 as well.

FIG. 3 also shows a person (not drawn to scale) using the immersible, surface compliant device 30 as well as potential current flow 61 that could be introduced to the pool or water tank as part of the methods of exercise and treatment disclosed herein. In some embodiments of the methods disclosed herein, an individual can use the immersible, surface compliant device 10, 30, 40 embodiments disclosed herein as a means of: rehabilitating from an injury, receiving treatment from a physical therapist or similar health care professional, seeking recreational options, creating a customized training regime; overcoming or working through a temporary or permanent disability; or as a way to perform exercise in a way that reduces the overall impact and load on one's joints while allowing for graded increases in resistance.

FIG. 3 shows an individual bounding on the immersible, surface compliant device 30 disclosed herein. In methods disclosed herein, the user can vary several parameters within the water to tailor the training sessions to the user's specific needs. For example, a user could alter a water temperature, a water type, a water depth, a water pressure, a water temperature, a current flow velocity, a current flow direction, a surface compliance measurement of the adjustable, immersible surface compliant device, a vertical angle of the adjustable, immersible surface compliant device, or a tilt angle of the adjustable, immersible surface compliant device.

If, for example, the user decides to alter the depth at which the immersible, surface compliant device is placed, he or she will be able to alter his or her buoyancy. The deeper the water, the more buoyant the user will be. In this way, the user will be lighter and the load he or she experiences on joints, muscles, the spine, and so forth will be minimized. As the user progresses and is able to accept more load, it would be possible with the inventions disclosed herein to vary the water depth so as to decrease buoyancy.

In addition, the type of water used can also affect buoyancy. If the immersible, surface compliant devices 10, 30, 40 disclosed herein are in salt water, the user will experience greater buoyancy than if the user is performing methods of use in fresh water, chlorinated water, mineral water, and the like.

The vertical angle, which is intended to mean the angle shown with respect to the x-y plane in FIG. 3, of the immersible, surface compliant device 10, 30, 40 will also alter the load on and exertion required by the user during exercise. The more vertical the angle, the more likely the user is going to bound in the x-direction as shown in FIG. 3. When the vertical angle of the immersible, surface compliant device 10, 30, 40 is closer to being horizontal, the bounding user will be forced in the vertical direction, absent any induced current flow. The steeper the vertical angle becomes, the more the user will be displaced in the horizontal direction when bounding in the absence of an induced current.

The benefits and strategies of using the immersible, surface compliant device 10, 30, 40 will also depend on whether or not there is an induced current flow 61 within the water. In Endless pools, and similar devices, it is possible to introduce a current which works against a swimmer in the pool. In this way, the swimmer is able to take advantage of the benefits of swimming in open water without having to have a large swimming pool, lake, or ocean within which to swim.

Similarly, in methods disclosed herein, an individual could exploit the current flow 61 within a pool or water tank as a means of training, rehabilitating, playing, relaxing, or exercising for pleasure. The current flow 61 in a pool or water tank is analogous to wind when flying in the sense that the current 61 induces drag against which the swimmer must fight in order to either swim forward or remain stationary. If there is a strong current 61, the user will have to overpower the current 61 in order to avoid being pushed into an interior wall of the pool or the immersible, surface compliant device 30. With less of a current 61, the user will still have to engage muscle strength to bound or swim against the current in order to avoid hitting the side of the pool or the immersible, surface compliant device 30.

In some embodiments, the methods disclosed herein could be used for extreme training such as that imparted to special operations forces, for example, Navy SEAL recruits. For elite training, the water temperature, type of water used, current flow 61, and firmness of the interior surface compliant portion could be varied so as to make conditions incrementally more challenging as a recruit progresses through training while also benefiting from reduced impact loads to musculoskeletal systems. Similarly, for an individual who was permanently or temporarily injured, these same variables could be altered as a way to provide progressive recovery for the individual.

For the Navy SEAL recruit, the water may be cold, fresh water, whereas for the injured individual the water may be warm, salt water. Current flow 61 for the recruit could be high, while it may begin at a low or null setting for the injured individual. Firmness of the interior surface compliant portion 32 may be high for the recruit and very low, tending toward being very compliant, for the injured individual.

Figure 4:
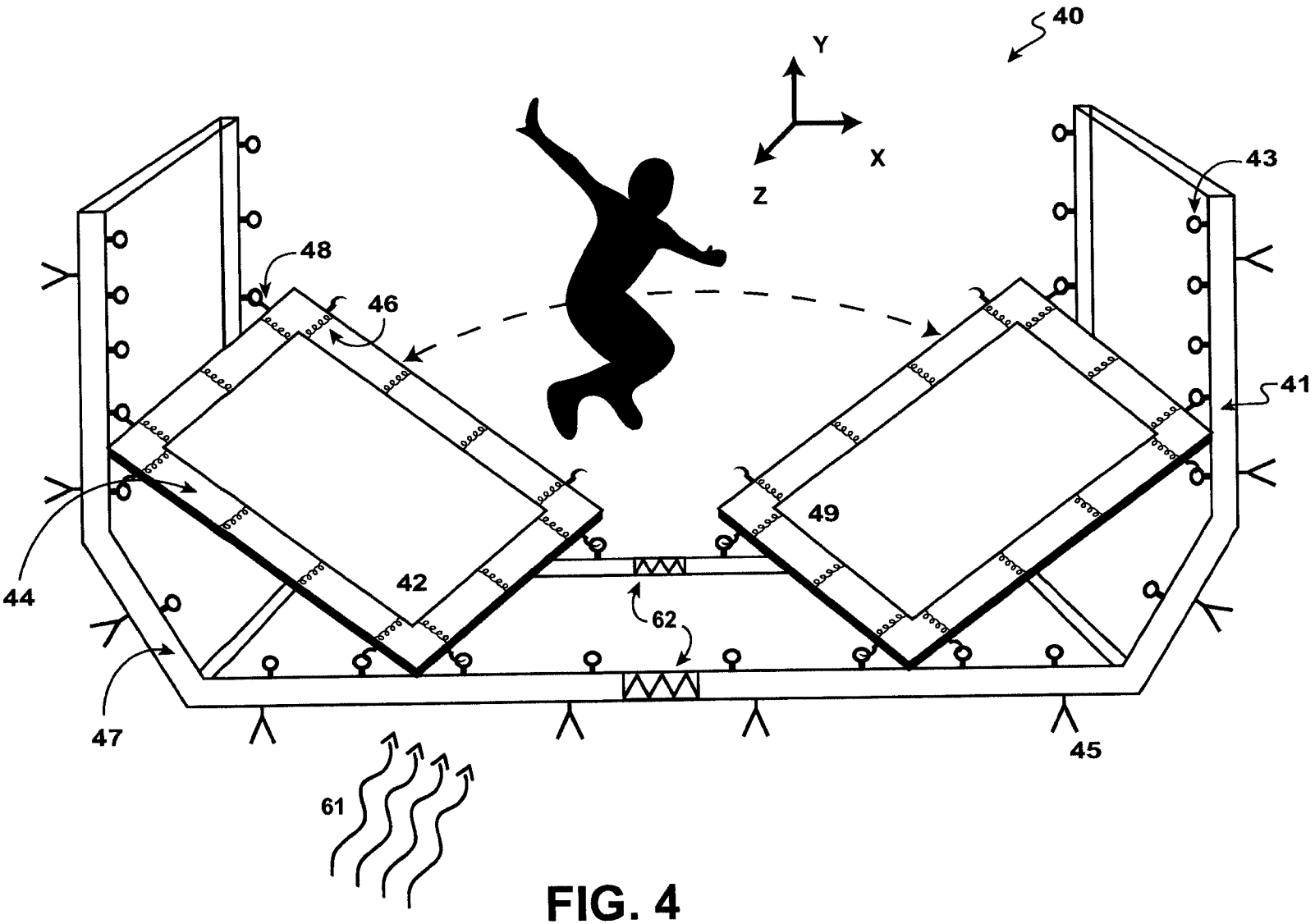
FIG. 4 is a perspective view of alternate embodiments of an immersible, adjustable, surface compliant device having a frame for attaching to the interior of a pool.

FIG. 4 depicts an alternate embodiment of the immersible, surface compliant device 40. In this embodiment, there is a first interior surface complaint portion 42 and a second interior surface complaint portion 49, which oppose each other and are mechanically coupled to a planar frame(s) 44 wherein the planar frame 44 further comprises at least one adjustable tension device 46, an interior pool frame 41 having a plurality of attachment points 43, means for securing the interior pool frame to a portion of a pool or a water tank 45, securing means 48 for coupling the planar frame 44 to the interior pool frame 41, an angled conjoining surface 47, and adjustment means 62

In this embodiment, the interior pool frame 41 could be attached across a width or length of a pool, water tank, or enclosure within a natural or man-made body of water. Adjustment means 62 can be used to vary the width, as shown in FIG. 4, of the interior pool frame 41. This width adjustment could be made to accommodate varying widths of the body of water in which the interior pool frame 41 is placed. Additionally, the width could be varied as a means of further challenging a user. The wider the distance between the first interior surface complaint portion 42 and a second interior surface complaint portion 49, the more challenging it will be for the user to bound from one side to another.

In terms of mechanically realizing adjustment means 62, those of skill in the art will recognize that hinges, clamps, ball and socket, hole and pin, telescoping devices, latches, rails, and the like could be integrally placed within interior pool frame 41 so as to provide a means for adjusting the width. Similar adjustment means could also be integrally inserted in interior pool frame 41 in the vertical y-direction so as to provide a adjustability of height as well.

This embodiment further allows for the introduction of current 61, the varying of angles of incline for the first 42 and second interior surface complaint portions 49, adjustability of firmness of the first 42 and second interior surface complaint portions 49 either by altering the material used for the first 42 and second interior surface complaint portions 49, or by adjusting the tension devices 46 like what was described for previous embodiments. The types of tension devices 46, attachment points 43, and securing means 48 are as described above with like reference numerals in reference to FIGS. 1-3.

In terms of differences in embodiments and methods of use associated with FIG. 4, in this embodiment, it is possible to alter, not only the vertical angle in the x-y plane of one or both of the first 42 and second interior surface complaint portions 49, it is also possible to alter the tilt angle of the first 42 and second interior surface complaint portions 49 along the x-z-plane as shown in FIG. 4, creating an obtuse tilt angle of incline for the first 42 and second interior surface complaint portions 49. Note that the x-y-z axes in FIG. 4 are to be viewed similar to the planar controls of pitch, roll, and yaw. This could be accomplished using a gimbal, hydraulic lift, or mechanical means such as ropes, tethers, straps, and the like affixed to the interior of the pool, water tank, or enclosure within a natural or man-made body of water.

In methods of use associated with the embodiments of FIG. 4, these embodiments could be used for the same methods of use described previously with reference to FIG. 3. In addition, individuals could use the embodiments of FIG. 4 for performing an exercise while being at least partially submerged underwater comprising bounding on an immersible, surface compliant device 40, wherein the immersible, surface compliant device is titled at a vertical angle along the x-y plane ranging from five degrees to eighty-nine degrees or a tilt angle along the x-z-plane ranging from five degrees to one hundred seventy-five degrees.

For clarity of reference, if the user wished to increase the vertical angle, he would detach both securing means 48 from the attachment points 43 shown in FIG. 4 and move both securing means 48 up to a more vertical attachment point 43. If the user wished to increase the tilt angle, he would detach a single securing means 48 and secure it to a higher attachment point 43. In this way, the tilt angle in the x-z plane would increase.

In some methods of use, there could be an induced current flow 61 pictured along the z-axis, but which in alternate embodiments could be along the x-axis, the y-axis, or any combination thereof.

In this embodiment, a user can bound between the opposing first 42 and second interior surface complaint portions 49 of the immersible, surface complaint device 40.

In methods using this embodiment, a user can alter a water temperature, a water type, a water depth, a water pressure, a water temperature, a current flow 61 velocity, a current flow 61 direction, a surface compliance measurement of the first 42 or second interior surface compliant portion 49 of the immersible surface compliant device 40, a vertical angle of the first 42 or second interior surface compliant portion 49 of the immersible surface compliant device 40, a tilt angle of the first 42 or second interior surface compliant portion 49 of the immersible surface compliant device 40, or a distance between the opposing first 42 or second interior surface compliant portion 49 of the immersible surface compliant device 40.

Those of skill in the art will recognize throughout this specification that when like terms are used to describe features and functionalities of various portions of a particular embodiment, those same features and functionalities could be present in additional embodiments having aspects with like terms.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The terms "coupled to" or "connected to" are intended to mean both a direct coupling or connection as well as a coupling or connection where there are one or more intermediary elements, devices, parts, and the like.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. A method of performing an exercise comprising:

providing a first frame;

at least partially submersing the first frame in water;

providing a second frame, the second frame having a first surface on which a user can bound and fasteners that are constructed and arranged to detachably secure the second frame to the first frame at a plurality of angles relative to a substantially horizontal plane;

attaching the first frame to the second frame with the fasteners at an angle relative to the substantially horizontal plane so that the first surface is at least partially submersed in the water; and wherein the first surface is construed and arranged to be bound on by the user.

2. The method of claim 1 further comprising altering a water temperature, a water type, a water depth, a water pressure, a current flow velocity, a current flow direction, a surface compliance measurement of the first surface, a vertical angle of the first surface, or a tilt angle of the first surface.

3. The method of claim 1 wherein the first surface comprises a mesh trampoline mat.

4. The method of claim 1 wherein the first surface further comprises one or more of: a mesh weave, a water permeability surface, and a variable mesh weave.

5. The method of claim 1 further comprising positioning the first surface in a flow of water.

6. The method of claim 5 further comprising the step of bounding within the flow of water.

7. The method of claim 1 further comprising providing a second surface positioned at a second angle relative to the horizontal plane.

8. The method of claim 7 further comprising the step of bounding from the first surface to the second surface within the water.

9. The method of claim 1 wherein the first frame comprises one or more fasteners to secure the first frame to an interior surface of a swimming pool.

10. The method of claim 9 wherein attaching the first frame comprises attaching the fasteners of the first frame to the interior surface of the swimming pool.

11. An apparatus for water exercise comprising:

a first frame;

a second frame, the second frame having a first surface on which a user can bound and fasteners that can detachably secure the second frame to the first frame at a plurality of angles relative to a substantially horizontal plane;

wherein the first and second frame comprise materials that can be submersed in water;

wherein the first frame comprises a vertical portion and a horizontal portion;

wherein the first frame comprises fasteners on the vertical portion and the horizontal portion that mate with the fasteners of the second frame.

12. The apparatus of claim 11 wherein the first frame comprises a second vertical portion, and the first vertical portion is positioned on one end of the horizontal portion and the second vertical portion is positioned on an opposite end of the horizontal portion.

13. The apparatus of claim 12 further comprising a third frame, the third frame having a surface on which a user can bound and fasteners that can detachably secure the third frame to the first frame at a plurality of angles relative to a substantially horizontal plane.

14. The apparatus of claim 13 wherein the second frame and the third frame are configured to be attached to the first frame at angles that allow the user to bound between the second and third frames.

15. The apparatus of claim 11 wherein the first frame comprises at least one securing means to connect the first frame to an interior surface of a swimming pool.

16. The apparatus of claim 11 wherein the second frame comprises tensioning devices that hold the first surface under tension.

17. The apparatus of claim 11 wherein the first surface comprises a mesh weave.

18. The apparatus of claim 11 wherein the first surface is configured to be positioned within a flow of water to allow the user to bound on the first surface while resisting the flow of water.

* * * * *